United States Patent [19]

Schuller et al.

[11] 4,136,621

[45] Jan. 30, 1979

[54] RAILWAY HOPPER CAR DOOR LOCKING MECHANISM

[75] Inventors: James J. Schuller, Crete, Ill.; William Raksanyi, Hammond, Ind.; Ray L. Ferris, Thornton, Ill.

[73] Assignee: Pullman Incorporated, Chicago, Ill.

[21] Appl. No.: 786,531

[22] Filed: Apr. 11, 1977

[51] Int. Cl.[2] ..... B61D 7/02; B61D 7/18; B61D 7/26; B61D 49/00

[52] U.S. Cl. ..... 105/308 E; 105/308 P

[58] Field of Search ..... 105/248, 259, 308 B, 105/308 E, 308 R, 310, 308 P; 292/24, 26

[56] References Cited

U.S. PATENT DOCUMENTS

| | | | |
|---|---|---|---|
| 699,820 | 5/1902 | Sage | 105/308 R X |
| 1,267,834 | 5/1918 | Yost | 105/259 |
| 1,584,417 | 5/1926 | Wine | 105/308 R |
| 1,658,600 | 2/1928 | Kadel | 105/308 E |
| 2,893,327 | 7/1957 | Lunde | 105/310 X |
| 3,240,165 | 3/1966 | Floehr | 105/308 R |
| 3,682,105 | 8/1972 | Marulic | 105/308 B X |

*Primary Examiner*—L. J. Paperner
*Assistant Examiner*—Howard Beltran
*Attorney, Agent, or Firm*—Thomas G. Anderson

[57] ABSTRACT

A locking arrangement for a hopper door includes a rotatable latch which is pivotally connected to rotate between open and closed positions. The latch is actuated by a link and bell crank lever arrangement which also locks the latch closed in an over-center position. The bell crank lever is rotated by a linkage arrangement and biasing means on the bell crank lever holds the same in an over-center position.

14 Claims, 2 Drawing Figures

RAILWAY HOPPER CAR DOOR LOCKING MECHANISM

BACKGROUND OF THE INVENTION

1. Field of the Invention

The field of invention relates to railway hopper cars and more specifically to locking mechanism for discharge doors on hoppers.

2. Description of the Prior Art

The prior art is exemplified in such patents as U.S. Pat. Nos. 1,658,600 Feb. 7, 1928 which discloses a hopper car door lock having an eccentric locking cam, 2,893,327 July 7, 1959 which shows a door operating mechanism for a gable bottom car, and 3,240,165 Mar. 15, 1966 which also shows a hopper car door locking mechanism.

SUMMARY OF THE INVENTION

In the present invention a railway hopper car includes one or more discharge hoppers having downwardly sloping walls which discharge material outwardly through a discharge opening below the hopper. The discharge opening is closed by a door which is generally hingedly connected to the upper end of the hopper and swings downwardly and outwardly with respect thereto. The present invention includes an improved locking arrangement for locking the door in a closed position. A bar type of keeper hook is secured to the lower end of the door adjacent to the bottom of the discharge opening. A bracket extends downwardly from one of the walls of the hopper and supports the locking mechanism which includes a rotatable latch element having an open end slot or jaw for engaging the keeper on the door to maintain the same in a locked position. The latch element in turn is activated for rotation by means of a first link which is connected to a bell crank rotatably mounted on the bracket below the hopper. The bell crank lever has a pivotal connection to the first link and upon rotation to a closed position the pivotal connection is disposed over-center with respect to the point of rotation of the latch element and point of rotation of the bell crank lever. A first stop on the bracket is engaged by the bell crank lever in the over-center position. The bell crank lever also has connected thereto a second link by pivotal connecting means. The second link also is connected to a chain which may be manually pulled by the operator for rotating the bell crank to its open position. The second link also includes a cam projection which in one position engages a second stop on the brackets to prevent rotation of the bell crank lever from its over-center position when the latch element is locked. A spring biasing arrangement also is pivotally connected to the bracket and assists in maintaining the bell crank lever in its over-center position.

DESCRIPTION OF THE PREFERRED EMBODIMENT

Figure 1:
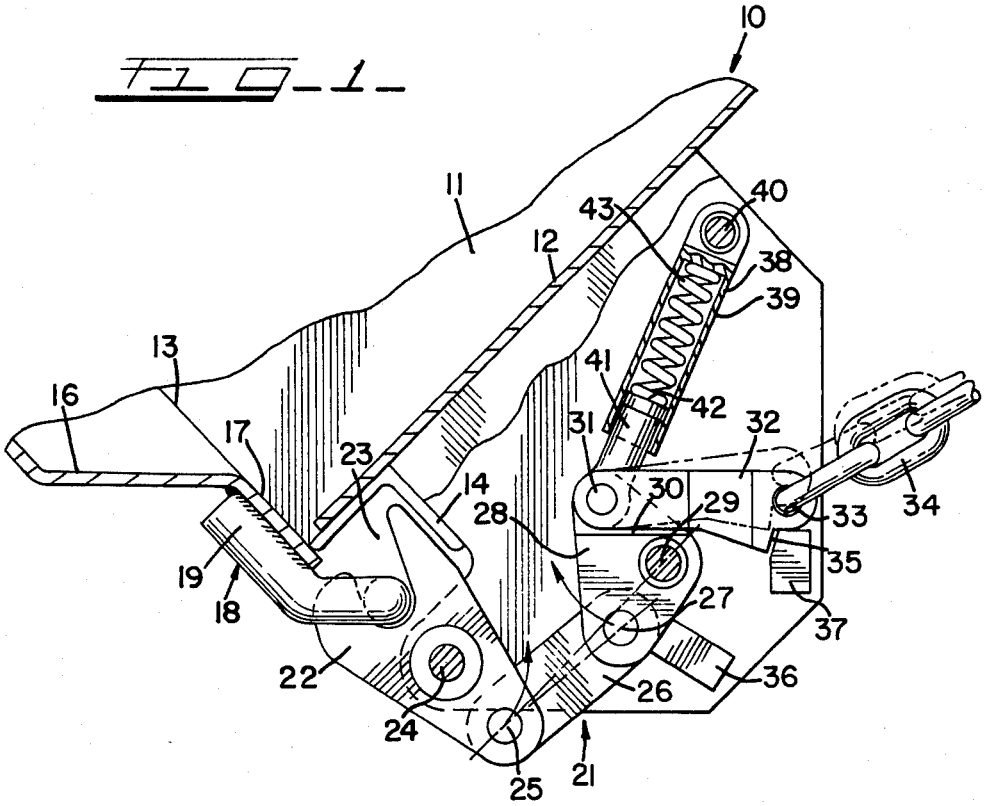
FIG. 1 is a cross-sectional view through the lower end of a hopper and door assembly showing the locking mechanism in its locked position.
Figure 2:
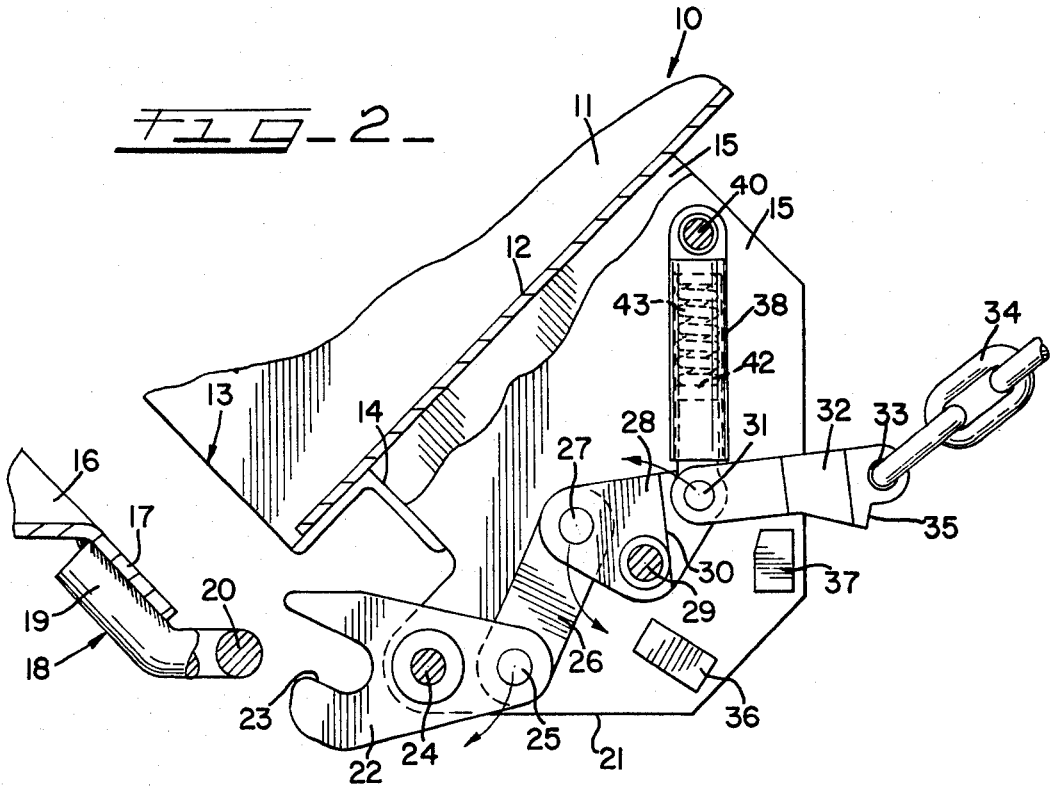
FIG. 2 is a view similar to FIG. 1 showing the locking mechanism in an unlocked position.

Referring to the drawing FIGS. 1 and 2 disclose a hopper 10 comprising side walls 11 and a sloping bottom wall 12 which forms a discharge opening 13. A transversely extending reinforcing angle 14, is connected to the outer most end of the sloping wall 12. The type of hopper arrangement which is disclosed is conventional and is disclosed in some of the aforementioned prior art patents and need not be more specifically described. The hopper 10 generally is positioned so that the sloping walls 12 extend laterally and is suitable for dumping materials from inside the hopper downwardly from a hopper car to suitable discharge bins provided underneath the tracks which may support the hopper car.

A pair of bracket plates 15 are suitably connected the the angle 14 and to the sloping bottom wall 12 and project downwardly in laterally spaced parallel relation. A door structure 16 includes a lower flat flange 17 engaging the reinforcing angle 14 in the closed position as shown in FIG. 1. The door structure 16 also is of conventional structure as shown in the aforementioned patents and is suitably hinged at the top of the hopper so as to move outwardly from a closed position whereby the load within the hopper may be discharged through the discharge opening. A cylindrical V-shaped keeper is designated at 18 and is suitably connected to the lower flange 17 of the door. The keeper 18 includes two cylindrical connecting portions 19 and a latch engaging portion 20 extending transversely between the connecting portions 19.

A locking arrangement 21 includes a latch element 22 which at one end is provided with an open end slot or jaw 23. The latch element 22 is provided with a central pivot pin 24 which is suitably supported on the bracket plates 15. The other end of the latch element 22 also includes a pivot pin 25 which is connected to a pair of links 26. The pair of links 26 at its other end is pivotally connected by means of a pivot pin 27 to a bell crank lever 28 which in turn is pivotally connected on a pivot shaft 29 supported on the bracket plates 15. The bell crank lever includes an under cut portion 30 which has a pivotal connection 31 to a second link 32. The second link 32 thus is pivotally connected to the bell crank lever and at one end thereof includes an eye 33 within which a chain 34 is connected. The second link 32 also includes a cam projection 35. The bracket plates 15 also supports first and second stops 36 and 37. The stop 36 as best shown in FIG. 1 is adapted to be engaged when the bell crank lever 28 is in an over-center position wherein the latch element 22 is in locking engagement with the keeper 18. The second stop 37 is adapted to be engaged by the cam projection 35 as best shown in FIG. 1 thereby effectively locking the bell crank lever 28 against rotation thereby maintaining the same in its over-center position.

The bell crank lever 28 is also maintained in the over-center position by a spring arrangement generally designated at 38. The spring arrangement 38 comprises a tubular housing 39 which is pivotally connected as indicated at 40 to the plate brackets 15. A link or plunger 41 is adapted to reciprocate in the tubular housing 39 and projects outwardly with respect thereto and is connected at its end to the pivot pin 31 and the bell crank lever 28. The link 41 is also provided with a piston end 42 which holds captive within the housing 39 a coil spring 43. The coil spring 43 continually urges the link 41 outwardly to assist in maintaining the bell crank lever in its over-center position.

THE OPERATION

FIG. 1 discloses the locking arrangement with the door rigidly held in closed position by means of the latch element 22. The latch element 22 is locked since the bell crank lever 28 is in an over-center position. The over-center position is achieved since the pivot 27 has moved below the phantom line disclosed in FIG. 1 which extends through the pivots 25 and 29. Also the bell crank lever 28 is seated upon the first stop 36 with the spring arrangement maintaining the lever in said engagement. Further fail-save locking is achieved in that the second link 32 has its cam projection 35 in substantially abutting or locking relation with respect to the second stop 37. Thus the door is securely locked and cannot accidentally open during over the road operation of the hopper car.

When the hopper car has arrived at its destination and the hoppers are to be dumped it is a simple operation for the operator to pull upwardly on the chain 34 and the link 32 to disengage the cam projection 35 from the cam stop 37. This action moves the bell crank lever 28 to the open position shown in FIG. 2 whereupon the door is then forced open by gravity and the load is dumped. The pivot point 31 of the bell crank lever 28 now has moved in substantially vertical alignement with the pivot 40 of the spring arrangement 38. In this position the link 32 resets on top of the stop 37. After the load has been dumped the doors are merely swung by the operator to a closed position whereupon the latch engaging portion 20 moves into the slot 23 thereupon pivoting the latch element 22. The bell crank lever is now moved to its locked position as shown in FIG. 1. The spring arrangement 38 is effective to urge the lever 28 and link 32 into the over-center locked position.

Thus it is believed an effective locking arrangement has been disclosed which includes features not disclosed in prior art patents.

What is claimed is:

1. In a hopper arrangement having a wall structure including a discharge opening, a downwardly swinging hopper door connected to said wall structure for opening and closing said discharge opening, the improvement comprising an over-center locking mechanism for said arrangement comprising;

a lock support bracket connected to said wall structure, a keeper member on said door, a latch element having a keeper engaging end portion, means pivotally mounting said latch element on said bracket adjacent to said opening, a first link including means pivotally connecting one end of said first link to said latch element, a bell crank lever pivotally mounted on said bracket, means pivotally connecting the other end of said first link to said bell crank lever, means connected to said bell crank lever for rotating the same to move the latch element through said first link between locking and unlocking engagement relative to said keeper, and the pivotal connection of said first link to said bell crank lever being movable to a latch locking, limiting over-center position relative to the pivotal connection of said first link to said latch element to secure said keeper engaging end portion in locking engagement with said keeper member.

2. The invention in accordance with claim 1, said keeper engaging end portion of said latch element including an open end slot positioned to one side of said pivotal mounting means of said latch element, and said means pivotally connecting said first link to said latch element being positioned on the other side of said pivotal mounting means.

3. The invention in accordance with claim 1, including first stop means on said bracket for maintaining said bell crank lever in said over-center position.

4. The invention in accordance with claim 3, said first stop means being engaged by said bell crank lever.

5. The invention in accordance with claim 1, said means for rotating said bell crank lever including a second link, means pivotally connecting one end of said second link to said bell crank lever, said second link including means for exerting a pulling force thereby rotating said lever.

6. The invention in accordance with claim 5, said means for exerting a pulling force on said second link including a chain.

7. The invention in accordance with claim 5, including a second stop on said bracket, and means on said second link engageable with said second stop for locking said lever in said over-center locking position.

8. The invention in accordance with claim 7, said means on said second link for engaging said second stop including a cam projection.

9. The invention in accordance with claim 8, said second link being pivotal about said means connecting the same to said bell crank levers for moving said cam projection relative to said second stop.

10. The invention in accordance with claim 1, including biasing means for urging said bell crank lever into said over-center position.

11. The invention in accordance with claim 10, said biasing means including a spring arrangement having one end pivotally supported on said bracket, and means pivotally connecting the other end of said arrangement to said bell crank lever.

12. In a hopper arrangement having a wall structure including a discharge opening, a downwardly swinging hopper door connected to said wall structure for opening and closing said discharge opening, the improvement of a locking mechanism for said arrangement comprising;

a lock support bracket connected to said wall structure, a keeper member on said door, a latch element having a keeper engaging end portion, means pivotally mounting said latch element on said bracket adjacent to said opening, a first link including means pivotally connecting one end of said first link to said latch element, a bell crank lever pivotally mounted on said bracket, means pivotally connecting the other end of said first link to said bell crank lever, said bell crank lever being rotatable whereby the pivoted connection of said first link to said bell crank lever is moved to an over-center position relative to the pivotal connection of said bell crank lever on said bracket and the pivotal connection of said first link to said latch element whereby said keeper engaging end portion is in locking engagement with said keeper member, means connected to said bell crank lever for rotating the same to move the latch element between locking and unlocking engagement relative to said keeper, having first stop means on said bracket for maintaining said bell crank lever in said over-center position, said means for rotating said bell crank lever including a second link, means pivotally connecting one end of said second link to said bell crank lever, said second link including means for exerting a pulling force thereby rotating said lever, having a biasing means pivotally supported on said bracket, and means on said biasing means connecting the same to said pivotal connecting means of said second link to said bell crank lever.

13. The invention in accordance with claim 12, said biasing means comprising a spring arrangement urging said bell crank lever to its over-center position.

14. The invention in accordance with claim 13, including a second stop on said bracket, said spring arrangement in one position urging said second link against said second stop to maintain said latch element in an open position.

* * * * *